US005080615A

United States Patent [19]

Kondo

[11] Patent Number: 5,080,615

[45] Date of Patent: Jan. 14, 1992

[54] BULB SOCKET AND METHOD OF MANUFACTURING THE SAME

[75] Inventor: Hiroyuki Kondo, Shizuoka, Japan

[73] Assignee: Yazaki Corporation, Japan

[21] Appl. No.: 641,864

[22] Filed: Jan. 16, 1991

[30] Foreign Application Priority Data

Jan. 16, 1990 [JP] Japan ..... 2-4488

[51] Int. Cl.[5] ..... H01R 13/00

[52] U.S. Cl. ..... 439/699

[58] Field of Search ..... 439/699, 682-685, 439/660

[56] References Cited

U.S. PATENT DOCUMENTS 4,181,390 1/1980 Aizawa ..... 439/699
4,365,396 12/1982 Baba et al. ..... 439/699
4,957,455 9/1990 Horiuchi et al. ..... 439/699

FOREIGN PATENT DOCUMENTS 63-187290 1/1990 Japan .

*Primary Examiner*—Joseph H. McGlynn

*Attorney, Agent, or Firm*—Wigman & Cohen

[57] ABSTRACT

A bulb socket for holding a bulb having wedge-shaped contact portions comprises (a) a socket housing (E) composed of a bulb holding portion (E1) and a connector holding portion (E2) formed integral with each other; and (b) two socket terminals (F) each composed of a bulb contact portion (F1) with a roughly rectangular base plate portion (1) and a pair of opposing extensional side walls (5) bent at both sides of and perpendicular to the base plate portion (1) so as to form a pair of opposing inwardly bent convex contact portions (3) at each free end of each extensional side wall (5), respectively; and a connector contact portion (F2) formed integral with the bulb contact portion (F1). Since the bulb contact portions (3) of the terminal can be formed by simply bending the extensional side walls (5) inwardly, respectively and further these bulb contact portions (F1) can be protected by an outer end (4) of the terminal base plate portion (1), the socket terminal (F) can be simplified in structure and therefore reduced in insertion molding cost by using a simple molding die including a simple core.

1 Claim, 5 Drawing Sheets

BULB SOCKET AND METHOD OF MANUFACTURING THE SAME

BACKGROUND OF THE INVENTION

1. Field of the Invention

The present invention relates to a wedge-base bulb socket and the manufacturing method thereof, and more specifically to an improvement in structure of a metallic contact terminal insertion-molded together with a resin socket body. The wedge-base bulb socket is suitable for use in holding a bulb for an automotive vehicle, in particular.

2. Description of the Prior Art

FIGS. 1(*a*) and (*b*) show an example of prior-art wedge-base bulb socket disclosed in Japanese Published Unexamined (Kokai) Utility Model Appli. No. 63-187290 filed by the same inventor. In these drawings, the bulb socket comprises a resin socket body A and a metallic terminal B. The bulb socket is molded by inserting a bulb contact portion B1 of the terminal B into a bulb holding portion A1 of the socket body A. This bulb contact portion B1 is formed with a pair of opposing inwardly bent convex contact portions 11 for holding a wedge-shaped contact portion of a bulb and a U-shaped wall 12 formed so as to surround the two opposing convex contact portions 11 to prevent resin material from flowing into a space between the two opposing convex contact portions 11 when the bulb socket is being insertion-molded.

Further, in FIGS. 1(*a*) and (*b*), the bulb socket A is further formed with a connector holding portion A2 formed integral with and perpendicular to the bulb holding portion A1, and the socket terminal B is further formed with a connector contact portion B2 formed integral with and perpendicular to the bulb contact portion B1.

In the prior-art socket, however, there exists a problem in that the terminal B is complicated in structure and weak in strength, because a pair of the opposing inwardly bent convex contact portions 11 are formed by bending these contact portions 11 at the lower end portions of two side walls 12*a* of the U-shaped wall 12 via two narrow joint portions 13.

Therefore, the bending process is large in the number of the bending steps and high in the material and manufacturing cost. In addition, the two joint portions 13 are easily broken at the bending process.

SUMMARY OF THE INVENTION

With these problems in mind, therefore, it is the primary object of the present invention to provide a bulb socket and the manufacturing method thereof, by which the terminal is simple in structure; low in manufacturing coot: and further resin can be securely prevented from flowing into the bulb contact portions in insertion molding process, without using any specific molding die.

To achieve the above-mentioned object, a bulb socket for holding a bulb having at least one wedge-shaped contact portion, comprising: (a) a socket housing (E) having a bulb holding portion (E1) and a connector holding portion (E2) formed integral with each other; and (b) at least one socket terminal (F) including: a bulb contact portion (F1) having a roughly rectangular base plate portion (1) and a pair of opposing extensional side walls (5) bent at both sides of and substantially perpendicular to the base plate portion (1) so as to form a pair of opposing inwardly bent convex contact portions (3) at each free end of each extensional side wall (5), respectively; and a connector contact portion (F2) formed integral with said bulb contact portion (F1).

Further, the base plate portion (1) extends so as to cover the two opposing inwardly bent convex contact portion (3) as a protective wall (4). Further, each extensional side wall (5) is preferably formed with a reinforcing plate portion (6) inwardly bent at the fixed end of each extensional side wall. The socket terminal (F) can be insertion molded together with the socket housing by use of a molding die, a core (G) formed with a space (9) for housing the bulb contact portion (F1).

In the socket according to the present invention, a pair of the opposing inwardly bent convex contact portions of the terminal can be formed by simply bending inwardly only the extensional side walls formed on both the sides of the terminal base portion. Further, these bulb contact portions can be protected by an outer end of the base plate portion, it is possible to simplify the structure of the bulb socket terminal, increase the strength of the bulb contact portion, reduce the material and manufacturing cost of the terminal, because the number of bending process steps can be reduced, without use of a high costly complicated molding die including complicated cores in the insertion-molding process thereof.

BRIEF DESCRIPTION OF THE DRAWINGS

FIG. 1(*b*) is an enlarged perspective view showing the same prior-art bulb socket terminal shown in FIG. 1(*a*);

FIG. 3(*b*) is a half, side and cross-sectional view taken along the line 3*b*—3*b* shown in FIG. 2;

FIG. 4(*b*) is a development elevation (expansion plane) of the contact terminal of the bulb socket.

DETAILED DESCRIPTION OF THE PREFERRED EMBODIMENT

Figure 1A:
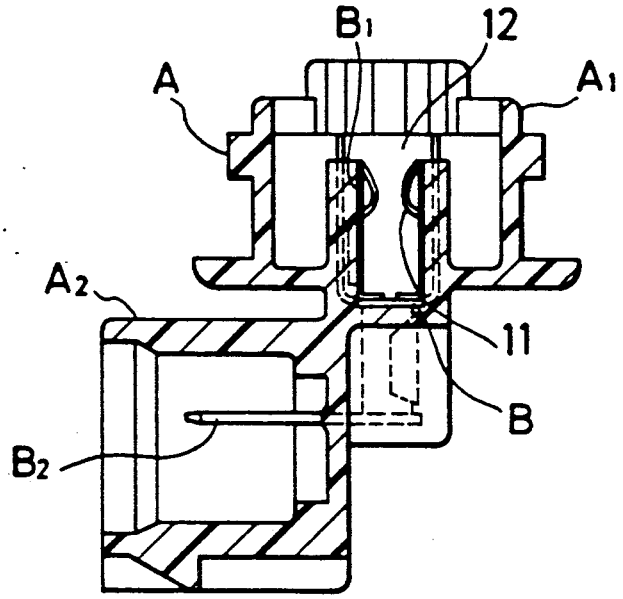
FIG. 1(a) PRIOR ART
FIG. 1(*a*) is a longitudinal cross-sectional view showing a prior-art bulb socket.
Figure 1B:
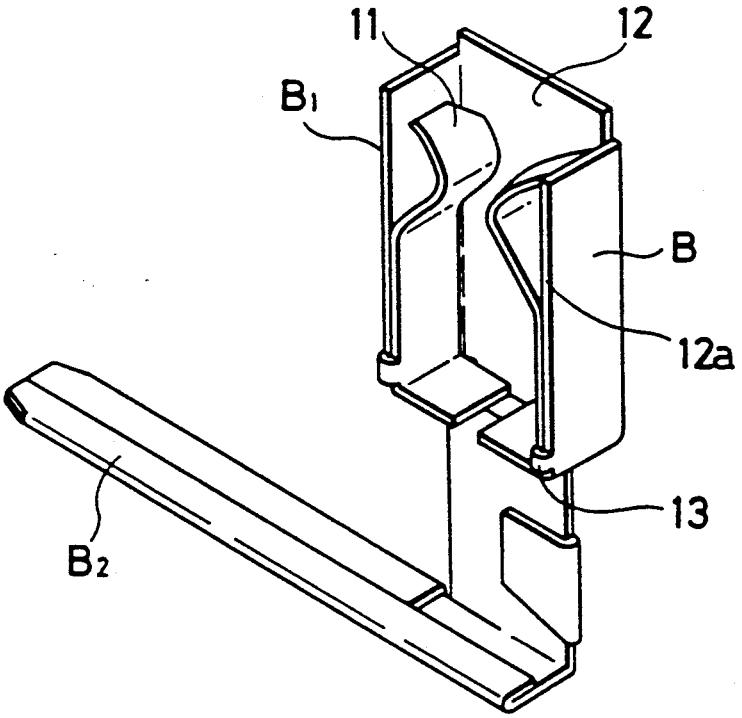
FIG. 1(b) PRIOR ART
Figure 2:
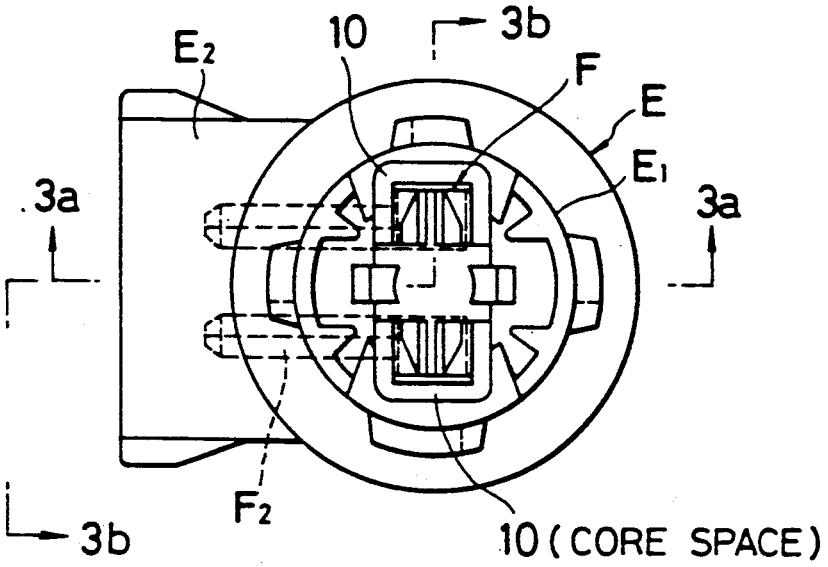
FIG. 2 is a top view showing an embodiment of the bulb socket according to the present invention.
Figure 3:
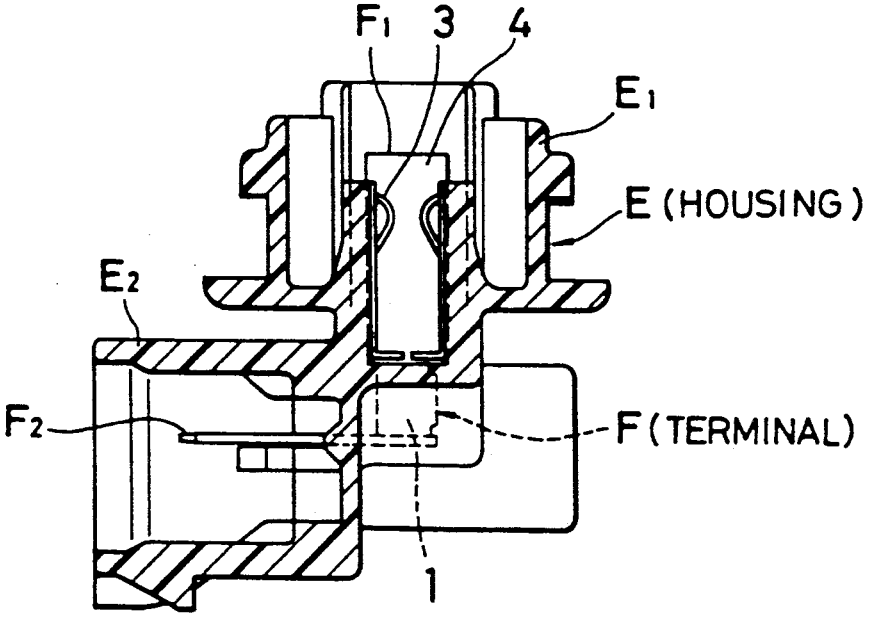
FIG. 3(*a*) is a cross-sectional view taken along the line 3*a*—3*a* shown in FIG. 2.
Figure 3:
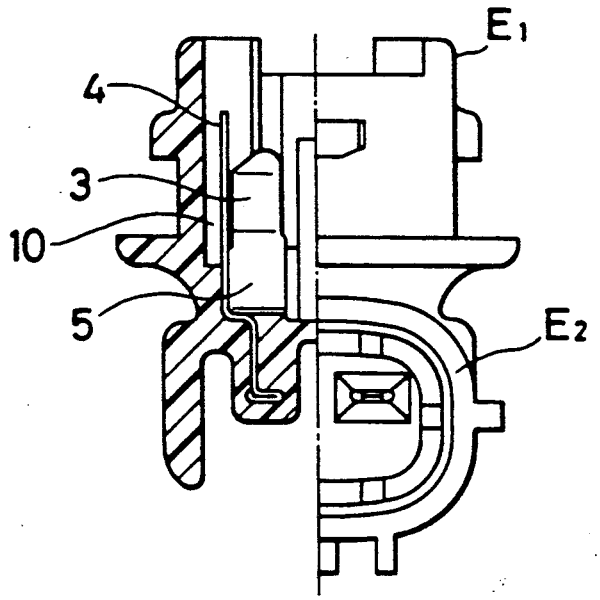

With reference to the attached drawings, an embodiment of the present invention will be described in more detail hereinbelow:

In FIGS. 2, 3(*a*) and 3(*b*), the bulb socket according to the present invention is composed of a resin socket housing (body) E and a metallic socket contact terminal F insertion-molded together with the socket housing E. The socket housing E is formed with a bulb holding portion E1 and a connector holding portion E2 formed integral with and perpendicular to the bulb holding portion E1.

Figure 4:
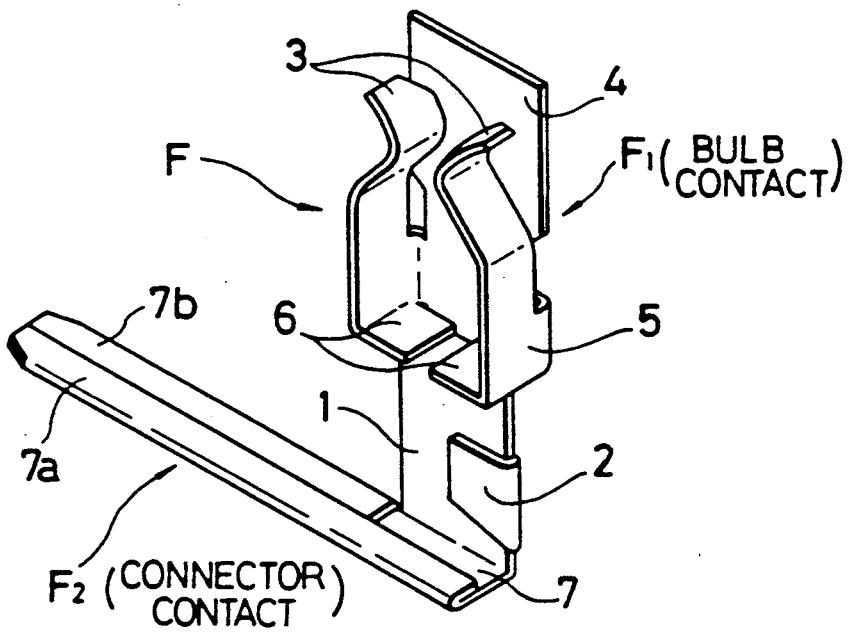
FIG. 4(*a*) is a perspective view showing the contact terminal of the bulb socket.
Figure 4:
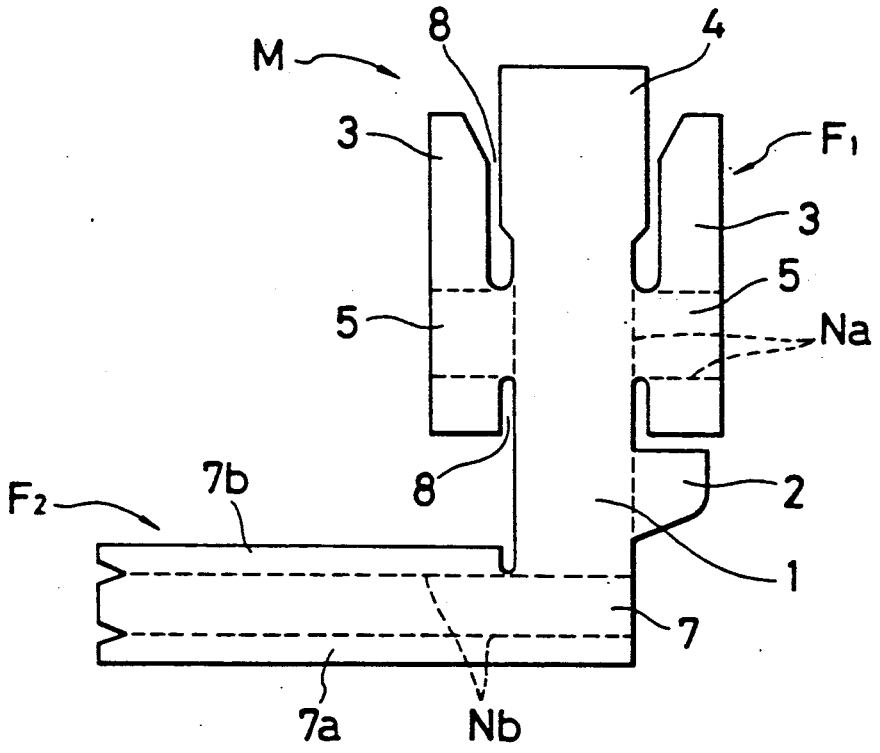

As shown in FIG. 4(*a*), the contact terminal F is formed with a bulb contact portion F1 and a connector contact portion F2 also formed integral with and perpendicular to the bulb contact portion F1. Further, the bulb contact portion F1 is formed with a roughly rectangular base plate portion 1 including a protective end wall 4 at an outer end thereof; a reinforcing piece portion 2 bent at an inner end thereof so as to be overlapped therewith; a pair of opposing extensional side walls 5 bent on both roughly middle sides of the base plate portion 1, respectively so as to provide a pair of opposing inwardly bent convex contact portions 3 bent at the free ends of the extensional side walls 5, respectively, so as to support a wedge-shaped contact of a bulb; and a pair of opposing bent reinforcing plate portions 6 also bent at the fixed ends of the extensional side walls 5, respectively. Further, the connector contact portion F2 is formed with a straight portion 7 bent at a right angle into L-shape at the inner end of the bulb contact portion F1, and two overlapped portions 7*a* and 7*b* bent along the two side surfaces of the straight portion 7 so as to form a male terminal mated with a female terminal (not shown).

FIG. 4(*b*) shows a development or expansion plane of the above-mentioned contact terminal F, which can be obtained by punching out a conductive metal material with a punching press. The punched blank material M as shown in FIG. 4(*b*) is further bent with a bending press along bending lines as shown by dashed lines Na and Nb. Further, in FIG. 4(*b*), the numeral 8 denotes slits formed between the base plate portion 1 and the contact portions 3 to facilite bending of the punched blank plate M.

Figure 5:
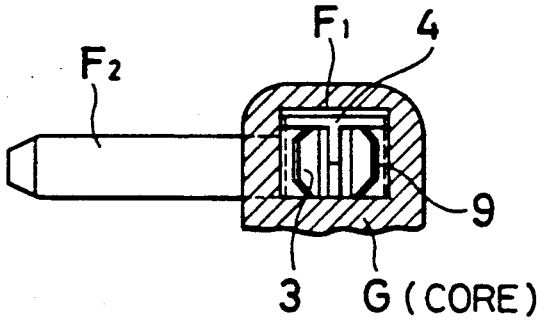
FIG. 5(*a*), (*b*) and (*c*) are top, front and side views showing the mutual positional relationship between the contact terminal F and a molding core G used for the insertion molding process of the bulb socket according to the present invention.
Figure 5:
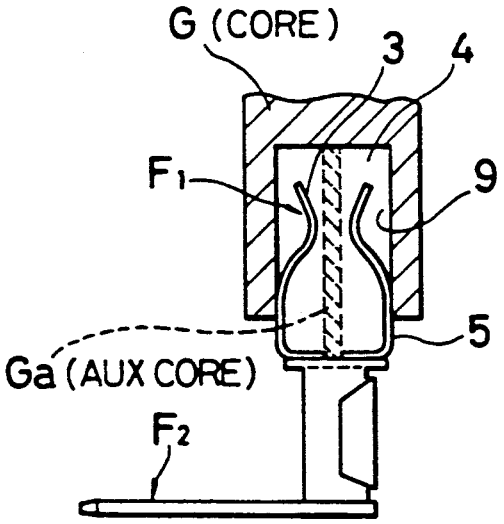
Figure 5:
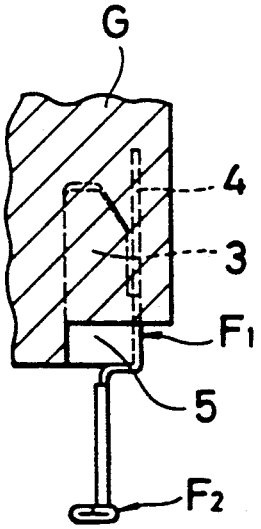

To insertion mold the two contact terminals F together with the socket housing E as shown in FIG. 2, two cores G as shown in FIGS. 5(*a*), (*b*) and (*c*) (only one is shown) are fitted into a metallic molding die (not shown) for insertion-molding the socket housing together with the contact terminal F, in order to form two spaces 9 in which the bulb contact portions F1 of the two contact terminals F are exposed so that the bulb wedge-shaped contact portions can be supported between the two opposing inwardly convex contact portions 3 of each of the two terminals F, respectively. Further, since a gap is formed between the two opposing reinforcing piece portions 6 as shown in FIG. 4(*a*), it is preferable to use an auxiliary core Ga as shown in FIG. 5(*b*) together with the core G, in order to prevent the molding resin material from entering into the space 9 through the above-mentioned gap during molding process. Further, since the core G as shown in FIG. 5 is used, after the core G has been removed from the molding die, it is possible to form a core space 10 (shown in FIG. 2) in the socket housing E.

As described above, in the bulb socket according to the present invention, since the structure of the bulb contact portion F1 of the contact terminal F is simple as compared with that of the prior-art bulb socket, it is possible to easily manufacture the bulb contact portion F1 without use of a special complicated molding die. Further, since it is possible to prevent melted resin material from flowing into the space between the two opposing inwardly bent convex contact portions of the contact terminals F by use simple cores, it is possible to markedly reduce the manufacturing cost of the bulb socket.

What is claimed is:

1. A bulb socket for holding a bulb having at least one wedge-shaped contact portion, comprising:

(a) a socket housing having a bulb holding portion and a connector holding portion formed integral with and perpendicular to each other; and (b) at least one socket terminal including:

(1) a bulb contact portion having a roughly rectangular base plate reinforced by a reinforcing portion and a pair of opposing extensional side walls bent at both sides of and substantially perpendicular to the base plate portion so as to form a pair of opposing inwardly bent convex contact portions at each free end of each extensional side wall, respectively, each extensional side wall being formed with a reinforcing plate portion inwardly bent at a fixed end thereof and adapted such that resin flow into the space between the two opposing side walls is prevented when the socket terminal is insertion molded together with said socket housing by use of a molding die, a core formed with a space for housing said bulb contact portion, and an auxiliary core for closing a gap between the two opposing reinforcing plate portions; and (2) a connector contact portion formed integral with an perpendicular to said bulb contact portion.

* * * * *